US007650107B2

(12) United States Patent
Kweon

(10) Patent No.: US 7,650,107 B2
(45) Date of Patent: Jan. 19, 2010

(54) DEVELOPING APPARATUS AND IMAGE FORMING APPARATUS HAVING THE SAME

(75) Inventor: Dae-seob Kweon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 174 days.

(21) Appl. No.: 11/838,459

(22) Filed: Aug. 14, 2007

(65) Prior Publication Data

US 2008/0193177 A1 Aug. 14, 2008

(30) Foreign Application Priority Data

Feb. 13, 2007 (KR) ..... 10-2007-0015064

(51) Int. Cl.
*G03G 21/00* (2006.01)

(52) U.S. Cl. ..... 399/351; 399/350; 399/111

(58) Field of Classification Search ..... 399/351, 399/350, 111
See application file for complete search history.

(56) References Cited

U.S. PATENT DOCUMENTS

2005/0084304 A1* 4/2005 Kataoka et al. ..... 399/346
2005/0238384 A1* 10/2005 Sampe et al. ..... 399/111
2006/0002736 A1* 1/2006 Kikuchi et al. ..... 399/111

FOREIGN PATENT DOCUMENTS

| | | | |
|---|---|---|---|
| JP | 61124979 A | * | 6/1986 |
| JP | 2002-49286 | | 2/2002 |
| JP | 2006-106465 | | 4/2006 |
| KR | 2001-84230 | | 9/2001 |
| KR | 2006-82193 | | 7/2006 |

* cited by examiner

*Primary Examiner*—David M Gray
*Assistant Examiner*—G. M. Hyder
(74) *Attorney, Agent, or Firm*—Stanzione & Kim LLP

(57) ABSTRACT

A developing apparatus and develops a developer with respect to a photosensitive medium, the and includes a developing cartridge which accommodates the developer therein; a cleaning blade which contacts the photosensitive medium by an end part thereof to clean the photosensitive medium, a guide member which guides the cleaning blade to linearly reciprocate, and an elastic member which elastically biases the cleaning blade toward the photosensitive medium.

14 Claims, 5 Drawing Sheets

DEVELOPING APPARATUS AND IMAGE FORMING APPARATUS HAVING THE SAME

CROSS-REFERENCE TO RELATED APPLICATIONS

This application claims priority under 35 U.S.C § 119(a) from Korean Patent Application No. 10-2007-0015064, filed on Feb. 13, 2007 in the Korean Intellectual Property Office, the disclosure of which is incorporated herein in its entirety by reference.

BACKGROUND OF THE INVENTION

1. Field of the Invention

The present general inventive concept relates to a developing apparatus and an image forming apparatus having the same, and to a developing apparatus and an image forming apparatus having the same, which clean a developer which has not been transferred on a photosensitive medium using a compact developing cartridge 2. Description of the Related Art In general, an electrophotographic image forming apparatus such as a laser printer, a facsimile, a digital copy machine, etc., scans a light onto a photosensitive medium charged to have a predetermined electric potential to form an electrostatic latent image, develops the latent image with a predetermined colored toner, and transfers and fuses the developed image to a printing medium to print the image.

FIG. 1 is a schematic sectional view illustrating a conventional electrophotographic image forming apparatus.

Referring to FIG. 1, the electrophotographic image forming apparatus includes a cabinet 10, a charging unit 11 provided inside the cabinet 10, a photosensitive medium 13, a light scanning unit 15, a developing cartridge 20, a transferring roller 17 and a fusing roller 19.

The photosensitive medium 13 is disposed inside the developing cartridge 20. The photosensitive medium 13 is charged to have a predetermined electric potential by the charging unit 11, and responds a light $L_1$ scanned from the light scanning unit 15 to form an electrostatic latent image corresponding to an image to be printed.

The developing cartridge 20 accommodates a developer $T_1$ in a developer accommodating part 25, and supplies the developer $T_1$ to the photosensitive medium 13 through an agitator 27, a supplying roller 24 and a developing roller 21 to form the image. Here, a regulating blade 23 is applied to an outer surface of the developing roller 21 to regulate the amount of the supplied developer $T_1$. The developer $T_1$ transported through the developing roller 21 passes between the regulating blade 23 and the developing roller 21 to form a developer layer having a predetermined thickness on the developing roller 21.

The image formed on the photosensitive medium 13 is transferred to a print medium $M_1$ transported between the photosensitive medium 13 and the transferring roller 17, and is fused to the print medium $M_1$ by the fusing roller 19.

A cleaner 30 removing a foreign substance such as a waste developer $W_1$ remaining after developing, etc., and a waste developer accommodating part 29 accommodating the foreign substance $W_1$ removed by the cleaner 30 are provided inside the developer cartridge 20.

The cleaner 30 includes a cleaning blade 31, an end part of which forcedly contacts an outer surface of the photosensitive medium 13, and a bracket 35 coupling the cleaning blade 31 to the developing cartridge 20. Here, the cleaning blade 31 is formed of material having a predetermined elasticity such as urethane, etc., and is adhered to the bracket 35. Accordingly, the cleaning blade 31 contacts the photosensitive medium 13 with a predetermined pressure to remove developer $T_1$ which has not been transferred and remains on the photosensitive medium 13 and other foreign substances.

In configuring the image forming apparatus, it is preferable to reduce the total size thereof. To assist this goal, the volume of the developing cartridge 20 may be reduced.

To reduce the size of the developing cartridge 20, it is helpful to reduce the diameter of the photosensitive medium 13 and to dispose the components in a more compact configuration.

The conventional cleaner 30 is disposed inside the developing cartridge 20 such that the cleaning blade 31 and the bracket 35 are disposed in a height direction of the developing cartridge 20. Also, because a free length 31 a of the cleaning blade 31 is long, and the height of the bracket 35 is high, there is a limit in in the ability to reduce the height of the developing cartridge 20.

Specifically, the cleaning blade 31 is generally formed of urethane, and a line pressure between the cleaning blade 31 and the photosensitive medium 13 is required to be approximately 15 g/cm$^2$ to 35 g/cm$^2$. To satisfy this, it is necessary to appropriately size the free length 31*a*. If the free length 31*a* is short, the line pressure increases. Accordingly, a driving torque of the photosensitive medium 13 increases, and the surface of the photosensitive medium 13 is abraded. Accordingly, because the free length 31*a* in the conventional cleaner 30 should not be shortened to be smaller than 4 mm, the reduction in the height of the developing cartridge 20 becomes problematic.

Also, in the conventional developing cartridge 20, the line pressure of the cleaning blade 31 depends on the free length 31*a* and a coupling position to the bracket 35. Accordingly, it is difficult to adjust the line pressure to a value within a predetermined range.

SUMMARY OF THE INVENTION

The present general inventive concept provides a developing apparatus and an image forming apparatus having the same with an enhanced cleaning performance, where abrasions of a photosensitive medium are minimized and/or where the height of a developing cartridge is reduced.

Additional aspects and utilities of the present general inventive concept will be set forth in the description which follows explicitly or will be obvious from the description, or may be learned by practice of the present inventive concept.

The foregoing and/or other aspects and utilities of the present inventive concept can be achieved by providing a developing apparatus which develops a developer with respect to a photosensitive medium, the developing apparatus including a developing cartridge which accommodates the developer therein, a cleaning blade which contacts the photosensitive medium by an end part thereof to clean the photosensitive medium, a guide member which guides the cleaning blade to linearly reciprocate, and an elastic member which elastically biases the cleaning blade toward the photosensitive medium.

The developing apparatus may further include a supporting member which is movably disposed inside the guide member, and supports the cleaning blade.

The foregoing and/or other aspects and utilities of the present inventive concept can also be achieved by providing a developing apparatus which develops a developer with respect to a photosensitive medium, the developing apparatus including: a developing cartridge which accommodates the developer therein, a cleaning blade which contacts the photosensitive medium by an end part thereof to clean the photosensitive medium, a supporting body which supports the cleaning blade, a holder which supports the opposite sides of the supporting body so that the supporting body can rotate inside the developing cartridge, and an elastic member which is interposed between the holder and the developing cartridge, and elastically presses the holder to elastically bias the cleaning blade toward the photosensitive medium.

The foregoing and/or other aspects and utilities of the present inventive concept can also be achieved by providing an image forming apparatus, including: a photosensitive medium, a light scanning unit which scans a beam to form an electrostatic latent image on the photosensitive medium, a developing apparatus which includes a developing cartridge which accommodates a developer therein, a cleaning blade which contacts the photosensitive medium by an end part thereof to clean the photosensitive medium, a guide member which guides the cleaning blade to linearly reciprocate, and an elastic member which elastically biases the cleaning blade toward the photosensitive medium, and a transferring unit which transfers an image formed by the developing apparatus to a print medium.

The developing apparatus may further include a supporting member which is movably disposed inside the guide member, and supports the cleaning blade.

The foregoing and/or other aspects and utilities of the present inventive concept can also be achieved by providing an image forming apparatus, including: a photosensitive medium, a light scanning unit which scans a beam to form an electrostatic latent image on the photosensitive medium, a developing apparatus which develops a developer with respect to the photosensitive medium, and a transferring unit which transfers an image formed by the developing apparatus to a print medium, the developing apparatus including: a developing cartridge which accommodates the developer therein, a cleaning blade which contacts the photosensitive medium by an end part thereof to clean the photosensitive medium, a supporting body which supports the cleaning blade, a holder which supports the opposite sides of the supporting body so that the supporting body can rotate inside the developing cartridge, and an elastic member which is interposed between the holder and the developing cartridge, and elastically presses the holder to elastically bias the cleaning blade toward the photosensitive medium.

The foregoing and/or other aspects and utilities of the present general inventive concept can also be achieved by providing an image forming apparatus comprising a photosensitive element, and a cleaning unit positioned against the photosensitive element to clean undesired substances from the photosensitive element, the cleaning unit including a blade positioned against the photosensitive element, a rigid holder connected to the blade, and an elastic element connected to the rigid holder to apply an elastic force to the rigid holder such that the blade is forced onto the photosensitive element.

The image forming apparatus may further comprise a developing cartridge in which developer and the cleaning unit is disposed, a cabinet to house the photosensitive medium and the developing cartridge, the cabinet may include a planar base to support the image forming apparatus and the elastic member of the cleaning unit may apply a force to the rigid member in a direction substantially parallel to the base.

The image forming apparatus may further comprise a developing cartridge in which developer and the cleaning unit is disposed, a cabinet to house the photosensitive medium and the developing cartridge, the cabinet may include a planar base to support the image forming apparatus and the length of the elastic member in a direction perpendicular to the planar base may be shorter than any length of the elastic member in any direction parallel to the planar base.

The foregoing and/or other aspects of the present general inventive concept can also be achieved by providing a developing apparatus, comprising a developing cartridge, a cleaning unit positioned within the cartridge to clean undesired substances from a photosensitive element of a image forming apparatus when the cartridge is inserted into an image forming apparatus, the cleaning unit including a blade, a rigid holder connected to the blade, and an elastic element connected to the rigid holder to apply an elastic force to the rigid holder such that the blade is forced onto the photosensitive element upon insertion of the cartridge into the image forming apparatus.

The foregoing and/or other aspects of the present general inventive concept can also be achieved by providing a developing apparatus comprising a developing cartridge, a cleaning unit positioned within the cartridge, the cleaning unit including a cleaning blade, a holder to which the cleaning blade is mounted, and an elastic member connected to the holder to provide an elastic force to the combination of the holder and cleaning blade, wherein the holder is movable within the cartridge and is biased by the elastic member towards an area configured to accept a photosensitive medium.

The developing cartridge may have a width greater than three times than the height of the developing cartridge.

The developing cartridge may have a width greater than four times the height of the developing cartridge.

The holder may be rotatably mounted within the cartridge and the size of the holder n the width direction of the developing cartridge may be greater than the size of the holder in the height direction of the developing cartridge.

The developing cartridge may include an area configured to receive a photosensitive roller, and the height of the developing cartridge may be less than two times the width of the area configured to receive the photosensitive roller.

The developing cartridge may include an area configured to receive a photosensitive roller, and the height of the developing cartridge may be less than one and a half times the width of the area configured to receive the photosensitive roller.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
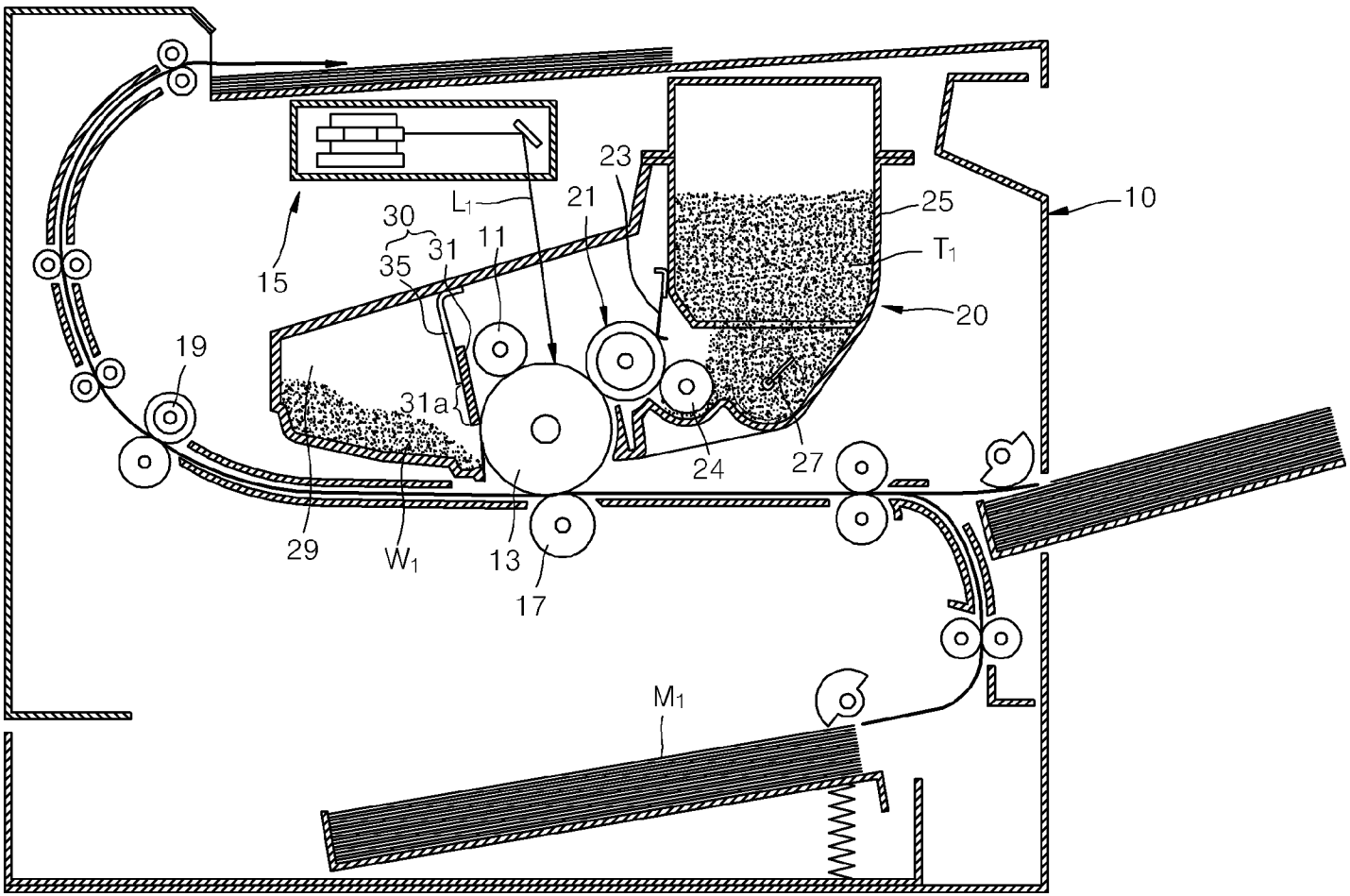
FIG. 1 (RELATED ART)
FIG. 1 is a sectional view illustrating a conventional electrophotographic image forming apparatus.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 2:
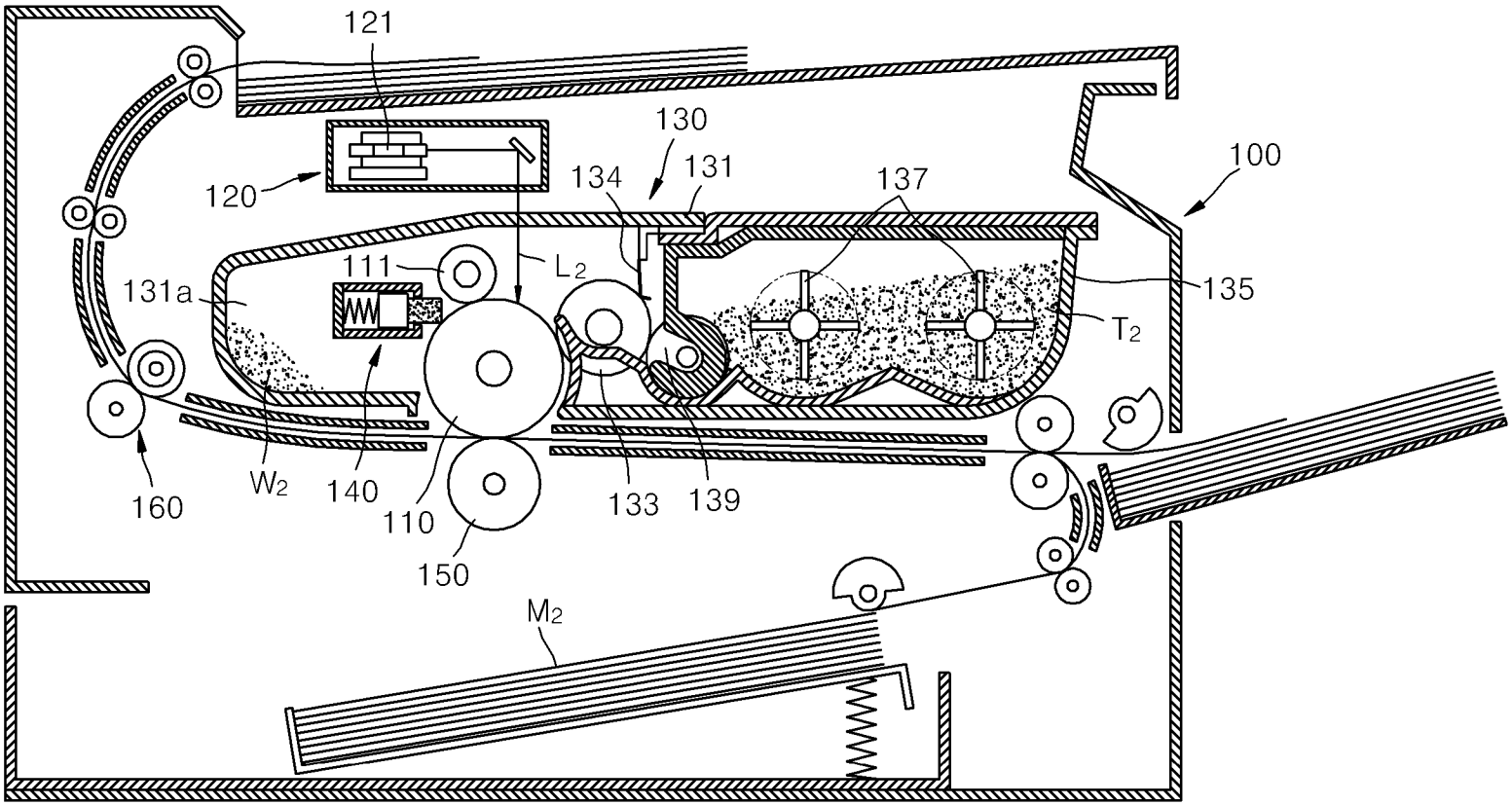
FIG. 2 is a sectional view illustrating an image forming apparatus according to an exemplary embodiment.

As illustrated in FIG. 2, an electrophotographic image forming apparatus according to an exemplary embodiment of the present inventive concept includes a photosensitive medium 110, a light scanning unit 120, a developing apparatus 130 and a transferring unit 150 which are provided inside a cabinet 100.

The photosensitive medium 110 is rotatably disposed inside the cabinet 100, that is, within a developing cartridge 131 of the developing apparatus 130. The photosensitive medium 110 is charged to have a predetermined electric potential by a charging unit 111, and responds a light $L_2$ scanned from the light scanning unit 120 to form an electrostatic latent image corresponding to an image to be printed. The photosensitive medium 110 may have a belt configuration instead of the roller configuration illustrated therein.

The light scanning unit 120 scans the light $L_2$ onto the photosensitive medium 110 charged to have the predetermined electric potential. The light scanning unit 120 scans the light $L_2$ in a main scanning direction, that is, a direction parallel with a rotation axis of the photosensitive medium 110 if the photosensitive medium 110 has the roller configuration, to form the electrostatic latent image corresponding to a desired image. The light scanning unit 120 includes a light source (not shown) emitting a laser beam, and a beam deflecting unit 121 deflecting the beam emitted from the light source. Here, the beam deflecting unit 121 may employ a rotating polygonal mirror rotated by a driving source as illustrated therein to scan the light. Alternatively, the beam deflecting unit 121 may employ a hologram disk (not shown) deflecting the light by diffracting the light by a hologram pattern formed on a surface of the hologram disk (not shown).

The developing apparatus 130 includes the developing cartridge 131, a container 135 accommodating a developer $T_2$ therein, and a cleaning unit 140 cleaning the photosensitive medium 110.

Also, the developing apparatus 130 includes a developing roller 133, and an agitator 137 and a supplying roller 139 employed for supplying the developer $T_2$ accommodated in the container 135 to the developing roller 133. Here, the agitator 137 is positioned in a lower position of the container 135 and agitates the developer $T_2$ supplied from the container 135 to prevent the developer $T_2$ from hardening, as well as to smoothly supply the developer $T_2$ to the supplying roller 139.

The developing roller 133 is disposed to face the photosensitive medium 110, and rotates in the same direction as the photosensitive medium 110. A predetermined voltage is applied to the developing roller 133. Accordingly, the developer $T_2$ is supplied to the photosensitive medium 110 to form an image on the photosensitive medium 110 by an electrophotographic method. Here, a regulating blade 134 may be further provided to an outer surface of the developing roller 133 to regulate the amount of the supplied developer $T_2$. The regulating blade 134 is disposed inside the developing cartridge 131 so that an end part thereof can contact the outer surface of the developing roller 133, and regulates a supply amount of the developer $T_2$ transferred to the photosensitive medium 110 through the developing roller 133.

Also, a waste developer accommodating part 131*a* is provided inside the developing cartridge 131 to accommodate a foreign substance $W_2$ such as a waste developer gathered by the cleaning unit 140 after developing.

The transferring unit 150 faces the photosensitive medium 110, and transfers an image developed on the photosensitive medium 110 to a print medium $M_2$. The transferring unit 150 may have a transferring belt configuration instead of the transferring roller configuration illustrated in FIG. 2. Also, the image forming apparatus according to the present inventive concept includes a fusing unit 160 fusing a non-fused image transferred to the print medium $M_2$.

The image forming apparatus a cleaning unit 140 configured to make the developing apparatus 130 and the image forming apparatus small. Hereinafter, the configuration of the cleaning unit 140 will be described in more detail.

The cleaning unit 140 is disposed inside the developing cartridge 131, and a contact line pressure between the cleaning unit 140 and the photosensitive medium 110 is adjusted by an elastic force to clean the photosensitive medium 110.

Figure 3:
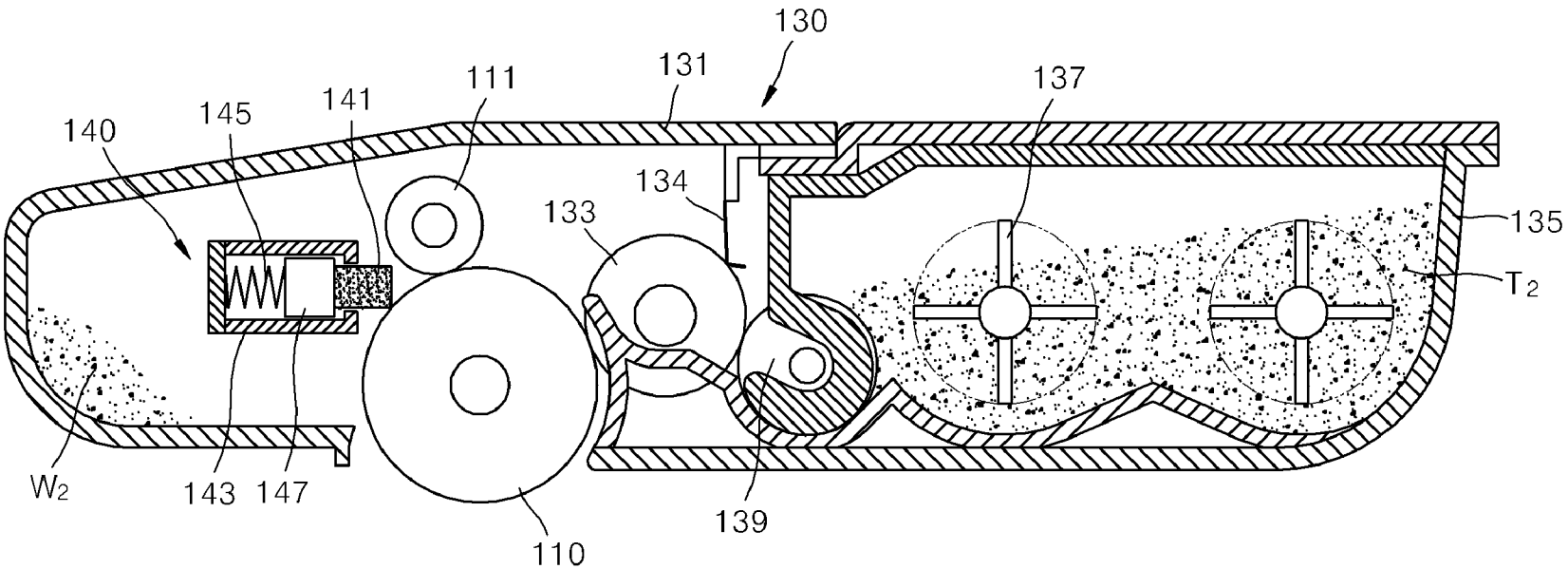
FIG. 3 is a sectional view illustrating a developing apparatus according to a first exemplary embodiment.

Referring to FIG. 3, the cleaning unit 140 according to a first exemplary embodiment includes a cleaning blade 141 to clean the photosensitive medium 110, a guide member 143 to guide the cleaning blade 141 to linearly reciprocate, and an elastic member 145.

The cleaning blade 141 is formed of a urethane rubber material, and an end part thereof contacts the photosensitive medium 110 to remove the foreign substance $W_2$ such as a waste toner remaining on a surface of the photosensitive medium 110.

For this, the elastic member 145 is interposed between the guide member 143 and the cleaning blade 141, and elastically biases the cleaning blade 141 toward the photosensitive medium 110. Accordingly, unlike the conventional cleaning configuration, the line pressure of the cleaning blade 141 can be adjusted by an elastic force of the elastic member 145. Accordingly, since it is unnecessary to secure a free length of the cleaning blade 141 greater than a predetermined length, the size thereof can be reduced. Also, as illustrated in FIGS. 2 and 3, since the cleaning blade 141 is arranged in a width direction, the cleaning blade 41 is not a limitation to minimizing the height of the developing apparatus 130.

Also, the cleaning unit 140 according to the first exemplary embodiment may further include a supporting member 147 supporting the cleaning blade 141. The supporting member 147 is formed of a rigid material, and is coupled to a side of the cleaning blade 141, facing the elastic member 145. Accordingly, the supporting member 147 linearly reciprocates inside the guide member 143 by the elastic force of the elastic member 145 to adjust the line pressure between the cleaning blade 141 and the photosensitive medium 110 within a predetermined range.

Figure 4:
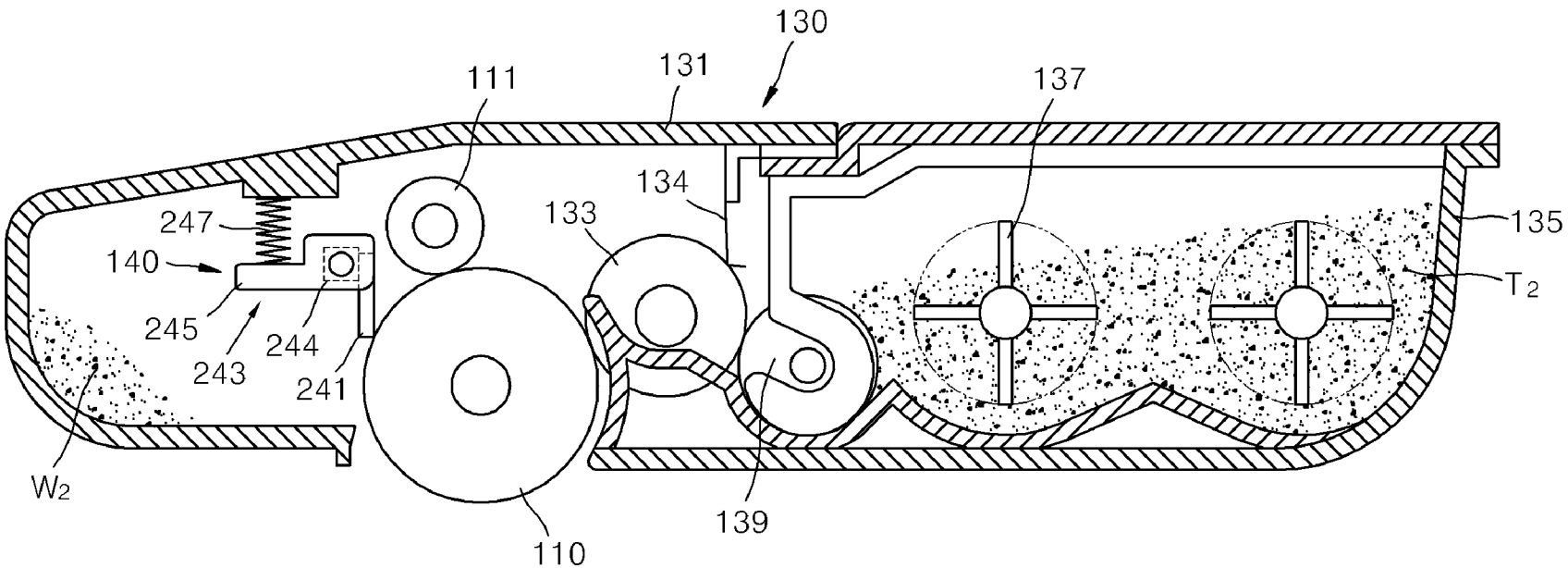
FIG. 4 is a sectional view illustrating a developing apparatus according to a second exemplary embodiment.
Figure 5:
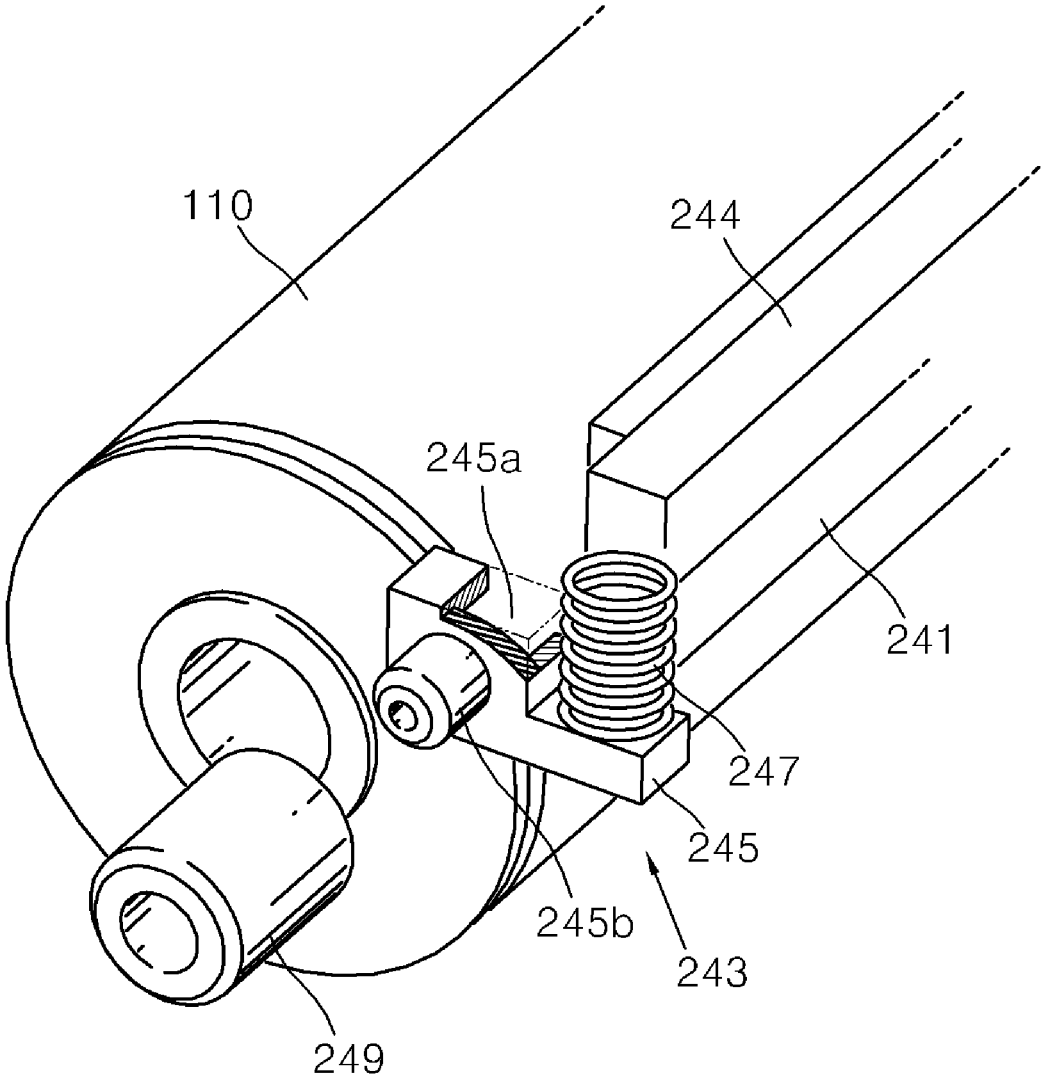
FIG. 5 is a side view illustrating a cleaning unit in FIG. 4.

Referring to FIGS. 4 and 5, a cleaning unit 140 according to a second exemplary embodiment includes a cleaning blade 241 cleaning the photosensitive medium 110, a rotation supporting member 243 rotatably supporting the cleaning blade 241, and an elastic member 247.

The cleaning blade 241 may be formed of a urethane rubber material, etc., and an end part thereof contacts the photosensitive medium 110 to remove a foreign substance such as a waste toner, etc. remaining on a surface of the photosensitive medium 110. Here, the cleaning blade 241 may be arranged in a height direction of the developing apparatus 130. Here, a free length (a length not overlapping with a supporting body 244) of the cleaning blade 241 may be determined to be smaller than approximately 4 mm. Accordingly, the height of the developing apparatus 130 can be reduced in arranging the cleaning blade 241.

Meanwhile, a problem of the line pressure increase caused by shortening of the free length can be addressed by the rotation supporting member 243 and the elastic member 247.

The rotation supporting member 243 includes the supporting body 244 supporting the cleaning blade 241, and a holder 245 coupling the supporting body 244 to the developing cartridge 131.

The supporting body 244 is formed of a rigid material, and is joined to the cleaning blade 241. The holder 245 supports the opposite sides of the supporting body 244 so that the supporting body 244 can rotate inside the developing cartridge 131.

The holder 245 includes a coupling groove 245*a* recessed so that the supporting body 244 can be coupled thereto, and an installation protrusion 245*b* to facilitate installation in the developing cartridge 131. Here, the installation protrusion 245*b* is freely rotatably when inserted into a rotation supporting pin 249 which is securely disposed to an inner frame (not shown) of the developing cartridge 131.

The elastic member 247 elastically biases the cleaning blade 241 toward the photosensitive medium 110. Accordingly, the cleaning blade 241 is rotatably pressed by an elastic force of the elastic member 247 so that the line pressure of the cleaning blade 241 can be controlled to be dispersed to the cleaning blade 241 and the elastic member 247. As illustrated in FIGS. 4 and 5, the elastic member 247 may exemplarily include a pressing spring interposed between the holder 245 and the developing cartridge 131 to elastically press the holder 245.

With the configuration of the cleaning unit 140, although the free length of the cleaning blade 241 is reduced to be smaller than 4 mm, increases of the line pressure and a driving torque of the photosensitive medium 110 can be avoided, and the photosensitive medium 110 can be prevented from being abraded.

As described above, a developing apparatus and an electrophotographic image forming apparatus having the same are configured to disperse a line pressure necessary for cleaning to a cleaning blade. An elastic member is used to adjust the line pressure rather than depending on only a free length of the cleaning blade. Therefore, the cleaning performance may be improved, a photosensitive medium may be prevented from being abraded and/or the height of a developing cartridge may be reduced by shortening the free length of the cleaning blade to be smaller than 4 mm.

Accordingly, positioning of components of the developing apparatus becomes less restrictive, to assist in reducing the size of the developing apparatus and the image forming apparatus having the same. In particular, as illustrated in FIGS. 3 and 4, a height of the developing apparatus can be made smaller than one third, and preferably smaller than one quarter of its width (left to right in FIGS. 3 and 4) or less. Furthermore, as shown in FIGS. 3 and 4, the height of the developing apparatus can be made smaller than two times the diameter of the photosensitive roller and preferably less than 1.5 times the diameter of the photosensitive roller.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. A developing apparatus which develops a developer with respect to a photosensitive medium, the developing apparatus comprising:

a developing cartridge which accommodates the developer therein;

a cleaning unit to clean the photosensitive medium;

a guide member connected to the developing cartridge to guide the cleaning unit to linearly reciprocate; and an elastic member disposed in the guide member to elastically bias the cleaning unit toward the photosensitive medium.

2. The developing apparatus according to claim 1, further comprising a supporting member which is movably disposed inside the guide member, and supports the cleaning unit.

3. An image forming apparatus, comprising:

a photosensitive medium;

a light scanning unit to scan a beam to form an electrostatic latent image on the photosensitive medium;

a developing apparatus which comprises a developing cartridge which accommodates a developer therein, a cleaning unit to clean the photosensitive medium, a guide member connected to the developing cartridge to guide the cleaning unit to linearly reciprocate, and an elastic member disposed in the guide member and to elastically bias the cleaning unit toward the photosensitive medium; and a transferring unit to transfer an image formed by the developing apparatus to a print medium.

4. The image forming apparatus according to claim 3, wherein the developing apparatus further comprises a supporting member which is movably disposed inside the guide member, and supports the cleaning unit.

5. An image forming apparatus comprising:

a photosensitive element; and a cleaning unit positioned against the photosensitive element to clean undesired substances from the photosensitive element, the cleaning unit including a blade positioned against the photosensitive element, a rigid holder connected to the blade, a rigid guide member to guide the cleaning unit, and an elastic member surrounded by the rigid guide member connected to the rigid holder to apply an elastic force to the rigid holder such that the blade is forced onto the photosensitive element.

6. The image forming apparatus of claim 5, wherein the blade of the cleaning unit is comprised of an elastic material.

7. The image forming apparatus of claim 6, wherein the blade is formed of urethane.

8. The image forming apparatus of claim 5, further comprising:

a developing cartridge, and wherein the cleaning unit is connected to an interior wall of the developing cartridge.

9. The image forming apparatus of claim 8, wherein the cleaning unit further includes the rigid guide member connected to an interior wall of the developing cartridge and wherein the rigid holder is movably positioned within the guide member and capable of transverse movement along a guide path established by the guide member.

10. The image forming apparatus of claim 9, wherein the elastic member of the cleaning unit is a spring positioned along the guide path established by the guide member and between a wall of the guide member and the rigid holder.

11. The image forming apparatus of claim 5, wherein the blade includes an extended portion which extends into space a distance which is not greater than 4 mm.

12. The image forming apparatus of claim 5, further comprising:

a developing cartridge in which developer and the cleaning unit is disposed;

a cabinet to house the photosensitive medium and the developing cartridge, the cabinet including a planar base to support the image forming apparatus;

wherein the elastic member of the cleaning unit applies a force to the rigid holder in a direction substantially parallel to the base.

13. The image forming apparatus of claim 5, further comprising:

a developing cartridge in which developer and the cleaning unit is disposed;

a cabinet to house the photosensitive medium and the developing cartridge, the cabinet including a planar base to support the image forming apparatus; and wherein the length of the elastic member in a direction perpendicular to the planar base is shorter than any length of the elastic member in any direction parallel to the planar base.

14. A developing apparatus, comprising:

a developing cartridge;

a cleaning unit positioned within the cartridge to clean undesired substances from a photosensitive element of an image forming apparatus when the cartridge is inserted into the image forming apparatus, the cleaning unit including a blade, a rigid holder connected to the blade, a guide member to guide the cleaning unit, and an elastic member surrounded by the guide member and connected to the rigid holder to apply an elastic force to the rigid holder such that the blade is forced onto the photosensitive element upon insertion of the cartridge into the image forming apparatus.

* * * * *